US010161266B2

(12) United States Patent
Ruthemeyer et al.

(10) Patent No.: US 10,161,266 B2
(45) Date of Patent: Dec. 25, 2018

(54) NOZZLE AND NOZZLE ASSEMBLY FOR GAS TURBINE ENGINE

(71) Applicant: General Electric Company, Schenectady, NY (US)

(72) Inventors: Michael Anthony Ruthemeyer, Cincinnati, OH (US); Richard William Albrecht, Jr., Fairfield, OH (US); Darrell Glenn Senile, Oxford, OH (US)

(73) Assignee: General Electric Company, Schenectady, NY (US)

( * ) Notice: Subject to any disclaimer, the term of this patent is extended or adjusted under 35 U.S.C. 154(b) by 576 days.

(21) Appl. No.: 14/862,330

(22) Filed: Sep. 23, 2015

(65) Prior Publication Data

US 2017/0082062 A1 Mar. 23, 2017

(51) Int. Cl.
*F01D 25/24* (2006.01)
*F01D 9/04* (2006.01)

(52) U.S. Cl.
CPC ..... *F01D 25/246* (2013.01); *F01D 9/04* (2013.01); *F05D 2240/128* (2013.01); *F05D 2240/14* (2013.01); *F05D 2300/6033* (2013.01)

(58) Field of Classification Search
None
See application file for complete search history.

(56) References Cited

U.S. PATENT DOCUMENTS 4,076,451 A * 2/1978 Jankot ..... F01D 5/284 415/200
4,391,565 A 7/1983 Speak
5,174,715 A 12/1992 Martin
5,211,536 A 5/1993 Ackermann et al.
6,200,092 B1 3/2001 Koschier
6,234,755 B1 5/2001 Bunker et al.
6,383,602 B1 5/2002 Fric et al.
6,904,757 B2 6/2005 Mitchell et al.
8,070,427 B2 12/2011 Snook et al.
8,572,981 B2 11/2013 Bunker
2004/0120813 A1 6/2004 Couture et al.
2011/0271684 A1 11/2011 Corsmeier et al.
2012/0251309 A1 10/2012 Beaujard et al.
2013/0052024 A1 2/2013 Brunt et al.
(Continued)

FOREIGN PATENT DOCUMENTS

EP 1 219 787 A1 7/2002
EP 1 408 198 A1 4/2004
(Continued)

OTHER PUBLICATIONS

Extended European Search Report and Opinion issued in connection with corresponding EP Application No. 6189529.7 dated May 15, 2017.

*Primary Examiner* — Dwayne J White
*Assistant Examiner* — Jason Davis
(74) *Attorney, Agent, or Firm* — General Electric Company; William Andes

(57) ABSTRACT

A nozzle for a gas turbine engine, including an airfoil having an exterior surface, flange and radially compressive contact face. Also included is an airfoil support frame having a mating face positioned in engagement with the contact face. A non-orthogonal engagement angle is provided in order to transmit a compressive force to the airfoil.

16 Claims, 11 Drawing Sheets

(56) References Cited

U.S. PATENT DOCUMENTS

| | | | | |
|---|---|---|---|---|
| 2013/0142660 | A1 | 6/2013 | McCaffrey | |
| 2013/0205791 | A1 | 8/2013 | Mongillo, Jr. et al. | |
| 2013/0205792 | A1 | 8/2013 | Gleiner et al. | |
| 2013/0209236 | A1 | 8/2013 | Xu | |
| 2014/0234118 | A1* | 8/2014 | Beaujard ..... | F01D 5/282 416/241 R |
| 2014/0341728 | A1 | 11/2014 | Cloarec et al. | |

FOREIGN PATENT DOCUMENTS

| | | | |
|---|---|---|---|
| EP | 2 647 847 | A1 | 10/2013 |
| FR | 2 985 792 | A1 | 7/2013 |
| WO | WO 2011005336 | A1 | 1/2011 |

* cited by examiner

NOZZLE AND NOZZLE ASSEMBLY FOR GAS TURBINE ENGINE

FIELD OF THE INVENTION

The present subject matter relates generally to nozzles and nozzle assemblies for gas turbine engines. More particularly, the present subject matter relates to nozzles having improved load transmission features.

BACKGROUND OF THE INVENTION

A gas turbine engine generally includes, in serial flow order, a compressor section, a combustion section, a turbine section and an exhaust section. In operation, air enters an inlet of the compressor section where one or more axial compressors progressively compress the air until it reaches the combustion section. Fuel is mixed with the compressed air and burned within the combustion section to provide combustion gases. The combustion gases are routed from the combustion section through a hot gas path defined within the turbine section and then exhausted from the turbine section via the exhaust section.

In particular configurations, the turbine section includes, in serial flow order, a high pressure (HP) turbine and a low pressure (LP) turbine. The HP turbine and the LP turbine each include various rotatable turbine components such as turbine rotor blades, rotor disks and retainers, and various stationary turbine components such as stator vanes or nozzles, turbine shrouds and engine frames. The rotatable and the stationary turbine components at least partially define the hot gas path through the turbine section. As the combustion gases flow through the hot gas path, thermal energy is transferred from the combustion gases to the rotatable turbine components and the stationary turbine components.

Nozzles utilized in gas turbine engines, and in particular HP turbine nozzles, are often arranged as an array of airfoil-shaped vanes extending between annular inner and outer bands which define the primary flowpath through the nozzles. Due to operating temperatures within the gas turbine engine, it is generally desirable to utilize materials having a low coefficient of thermal expansion and high compression strength. Recently, for example, ceramic matrix composite ("CMC") materials have been utilized to operate effectively in such adverse temperature and pressure conditions. These low-coefficient-of-thermal-expansion materials have higher temperature capability than similar metallic parts, so that, when operating at the higher operating temperatures, the engine is able to operate at a higher engine efficiency.

However, CMC materials have mechanical properties that must be considered during the design and application of the CMC. For example, CMC materials have relatively low tensile ductility or low strain to failure when compared to metallic materials.

Typical vanes are held within the turbine engine using radial pins disposed through a vane band or engine support. During operation, these pins can create high tangential loads and stress concentrations for the nozzle and associated attachment features. In addition, existing pins can create high tensile loads that may be especially harmful to CMC materials. Therefore, if a CMC component is restrained using certain pin structures, stress concentrations can develop leading to a shortened life of the segment.

To date, nozzles formed of CMC materials have experienced localized stresses that have exceeded the capabilities of the CMC material, leading to a shortened life of the nozzle. The stresses have been found to be due to moment stresses imparted to the nozzle and associated attachment features, differential thermal growth between parts of differing material types, and loading in concentrated paths at the interface between the nozzle and the associated attachment features.

Accordingly, improved nozzles and nozzle assemblies are desired in the art.

BRIEF DESCRIPTION OF THE INVENTION

Aspects and advantages of the invention will be set forth in part in the following description, or may be obvious from the description, or may be learned through practice of the invention.

In accordance with one embodiment of the present disclosure, a nozzle for a gas turbine engine is provided. The nozzle may include an airfoil disposed along a radial axis. The airfoil may include an exterior surface defining a pressure side and a suction side extending between a leading edge and a trailing edge. The airfoil may also include a flange extending axially in engagement with the exterior surface, and a radially compressive contact face defined on the flange at an engagement angle non-orthogonal to a centerline of the engine. The compressive contact face is configured to transmit a compressive force perpendicular to the engagement angle. The nozzle may further include an airfoil support frame radially enclosing the airfoil, the airfoil support frame including a mating face positioned in engagement with the compressive contact face.

In accordance with another embodiment of the present disclosure, a nozzle for a gas turbine engine is provided. The nozzle may include an airfoil disposed along a radial axis, the airfoil including an airfoil disposed along a radial axis. The airfoil may include an exterior surface defining a pressure side and a suction side extending between a leading edge and a trailing edge. The airfoil may also include a flange extending axially in engagement with the exterior surface, and a radially compressive contact face radially positioned away from the exterior surface. The nozzle may further include an airfoil support frame radially enclosing the airfoil, the airfoil support frame including a support body, and a mating face defined on the support body at an engagement angle non-orthogonal to the centerline, the mating face being positioned in engagement with the compressive contact face along the engagement angle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
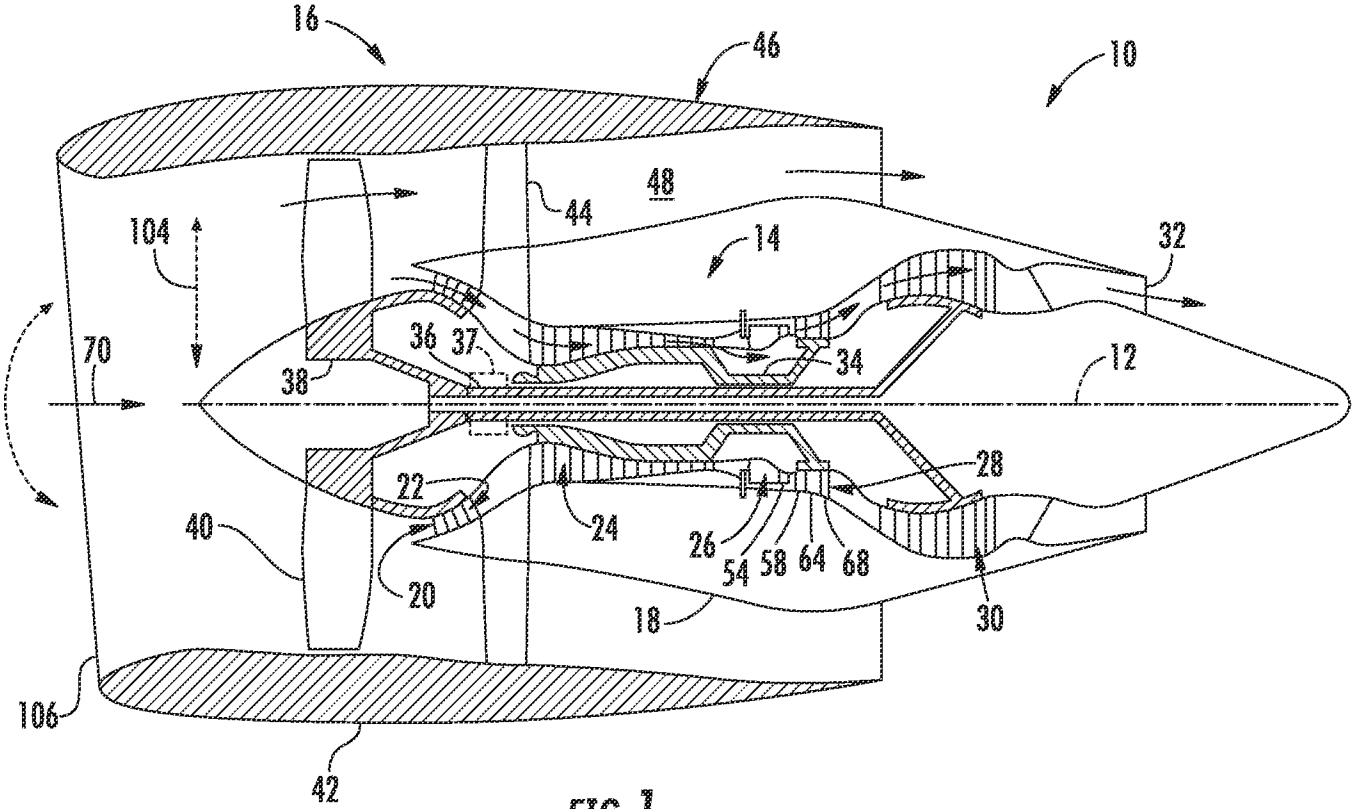
FIG. 1 is a schematic cross-sectional view of a gas turbine engine in accordance with one embodiment of the present disclosure.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Further, as used herein, the terms "axial" or "axially" refer to a dimension along a longitudinal axis of an engine. The term "forward" used in conjunction with "axial" or "axially" refers to a direction toward the engine inlet, or a component being relatively closer to the engine inlet as compared to another component. The term "rear" used in conjunction with "axial" or "axially" refers to a direction toward the engine nozzle, or a component being relatively closer to the engine nozzle as compared to another component. The terms "radial" or "radially" refer to a dimension extending between a center longitudinal axis of the engine and an outer engine circumference.

Referring now to the drawings, FIG. 1 is a schematic cross-sectional view of an exemplary high-bypass turbofan type engine 10 herein referred to as "turbofan 10" as may incorporate various embodiments of the present disclosure. As shown in FIG. 1, the turbofan 10 has a longitudinal or axial centerline axis 12 that extends therethrough for reference purposes. In general, the turbofan 10 may include a core turbine or gas turbine engine 14 disposed downstream from a fan section 16.

The gas turbine engine 14 may generally include a substantially tubular outer casing 18 that defines an annular inlet 20. The outer casing 18 may be formed from multiple casings. The outer casing 18 encases, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30, and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22. The (LP) spool 36 may also be connected to a fan spool or shaft 38 of the fan section 16. In particular embodiments, the (LP) spool 36 may be connected directly to the fan spool 38 such as in a direct-drive configuration. In alternative configurations, the (LP) spool 36 may be connected to the fan spool 38 via a speed reduction device 37 such as a reduction gear gearbox in an indirect-drive or geared-drive configuration. Such speed reduction devices may be included between any suitable shafts/spools within engine 10 as desired or required.

As shown in FIG. 1, the fan section 16 includes a plurality of fan blades 40 that are coupled to and that extend radially outwardly from the fan spool 38. An annular fan casing or nacelle 42 circumferentially surrounds the fan section 16 and/or at least a portion of the gas turbine engine 14. It should be appreciated by those of ordinary skill in the art that the nacelle 42 may be configured to be supported relative to the gas turbine engine 14 by a plurality of circumferentially-spaced outlet guide vanes 44. Moreover, a downstream section 46 of the nacelle 42 (downstream of the guide vanes 44) may extend over an outer portion of the gas turbine engine 14 so as to define a bypass airflow passage 48 therebetween.

Figure 2:
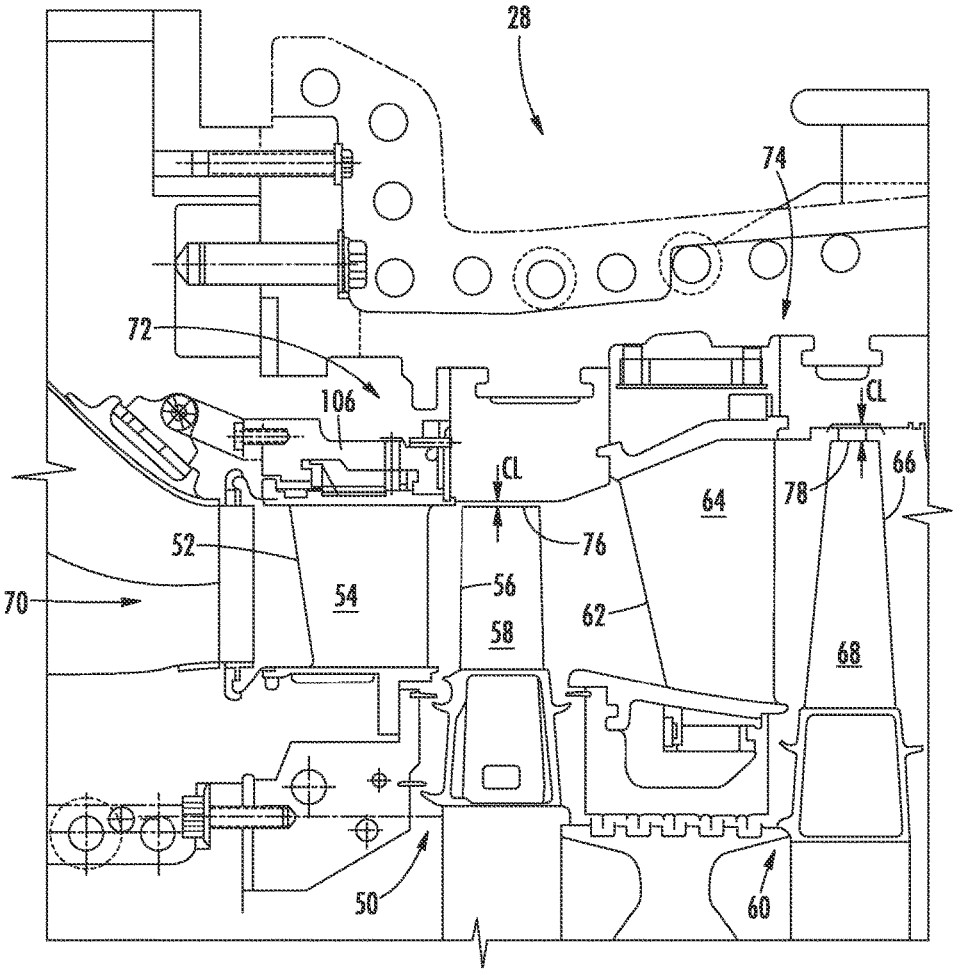
FIG. 2 is an enlarged circumferential cross sectional side view of a high pressure turbine portion of a gas turbine engine in accordance with one embodiment of the present disclosure.
Figure 3:
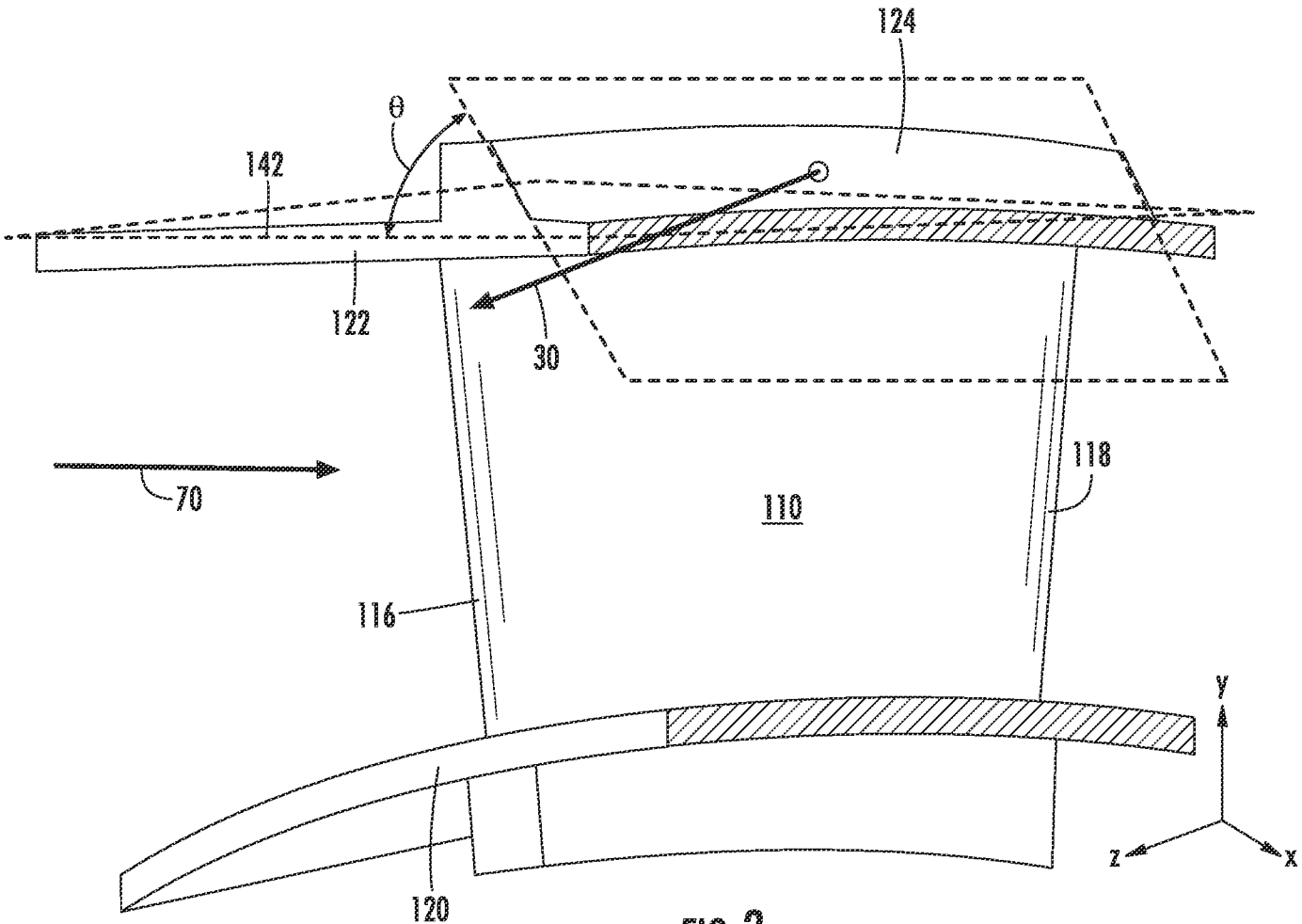
FIG. 3 is a top aft perspective view of a portion of a nozzle in accordance with one embodiment of the present disclosure wherein a flange includes an outer angled contact face.
Figure 4:
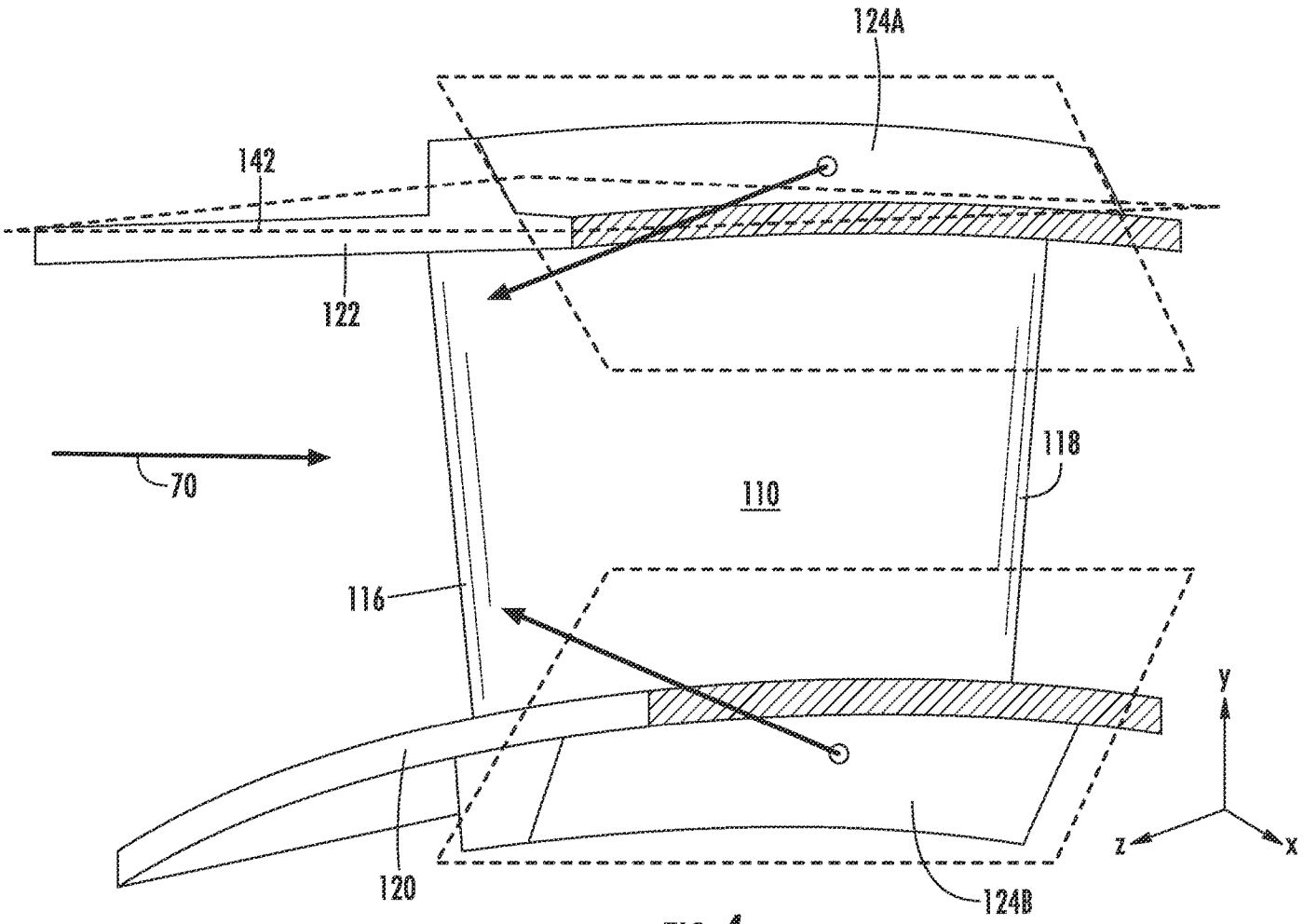
FIG. 4 is a top aft perspective view of a nozzle in accordance with one embodiment of the present disclosure wherein an outer flange includes an outer angled contact face and an inner flange includes an inner angled contact face.

FIG. 2 provides an enlarged cross sectioned view of the HP turbine 28 portion of the gas turbine engine 14 as shown in FIG. 1, as may incorporate various embodiments of the present invention. As shown in FIG. 2, the HP turbine 28 includes, in serial flow relationship, a first stage 50 which includes an annular array 52 of stator vanes 54 (only one shown) axially spaced from an annular array 56 of turbine rotor blades 58 (only one shown). The HP turbine 28 further includes a second stage 60 which includes an annular array 62 of stator vanes 64 (only one shown) axially spaced from an annular array 66 of turbine rotor blades 68 (only one shown). The turbine rotor blades 58, 68 extend radially outwardly from and are coupled to the HP spool 34 (FIG. 1). As shown in FIG. 2, the stator vanes 54, 64 and the turbine rotor blades 58, 68 at least partially define a hot gas path 70 for routing combustion gases from the combustion section 26 (FIG. 1) through the HP turbine 28.

As further shown in FIG. 2, the HP turbine may include one or more shroud assemblies, each of which forms an annular ring about an annular array of rotor blades. For example, a shroud assembly 72 may form an annular ring around the annular array 56 of rotor blades 58 of the first stage 50, and a shroud assembly 74 may form an annular ring around the annular array 66 of turbine rotor blades 68 of the second stage 60. In general, shrouds of the shroud assemblies 72, 74 are radially spaced from blade tips 76, 78 of each of the rotor blades 58, 68. A radial or clearance gap CL is defined between the blade tips 76, 78 and the shrouds. The shrouds and shroud assemblies generally reduce leakage from the hot gas path 70.

It should be noted that shrouds and shroud assemblies may additionally be utilized in a similar manner in the low pressure compressor 22, high pressure compressor 24, and/or low pressure turbine 30. Accordingly, shrouds and shrouds assemblies as disclosed herein are not limited to use in HP turbines, and rather may be utilized in any suitable section of a gas turbine engine.

Referring now to FIGS. 3-13, various embodiments of nozzle assemblies 100 and nozzles 102 therefor are disclosed. Nozzles 102, as disclosed herein, may be utilized in place of stator vanes 54, stator vanes 64, or any other suitable stationary airfoil-based assemblies in an engine.

As shown, the nozzle 102 includes an airfoil 110, which has an exterior surface defining a pressure side 112, a suction side 114, a leading edge 116 and a trailing edge 118. The pressure side 112 and suction side 114 extend between the leading edge 116 and the trailing edge 118, as is generally understood. In typical embodiments, airfoil 110 is generally hollow to allow cooling fluids to be flowed therethrough and structural reinforcement components to be disposed therein.

The embodiments shown in FIGS. 3-13 include a nozzle 102 having an inner flange 120 and an outer flange 122, each of which is connected to the airfoil 110 at radially outer ends thereof, generally in a direction of the radial axis 104. The inner flange 120 and outer flange 122 also extends along the airfoil 110 in axial engagement with the airfoil's exterior surface. The inner and outer flanges 120, 122, thereby, provide a mounting surface that allows the airfoil to be joined to the shroud assembly 72, 74. As shown in FIGS. 3-13, the flanges 120, 122 includes one or more radially compressive contact faces 124 defined along an engagement angle θ.

The contact face 124 of some embodiments includes a protrusion tab 128 extending toward the shroud assemblies, as illustrated in FIGS. 6, 9, 11, and 13. In certain embodiments of the outer flange 122, an outer protrusion tab 128A extends radially outwards towards the outer shroud assembly 72 while an inner protrusion tab 128B extends towards the centerline 12. In such embodiments, the protrusion tab 128 generally extends perpendicular to the engagement angle θ. The engagement angle θ of the protrusion tab 128 thereby directs a compressive force 130 through the tab 128 and to the airfoil. Optionally, the protrusion tab 128 may be integrally formed with the flange 120, 122. Alternatively, the protrusion tab 128 may be separately attached via an adhesive or mechanical fastener.

Figure 6:
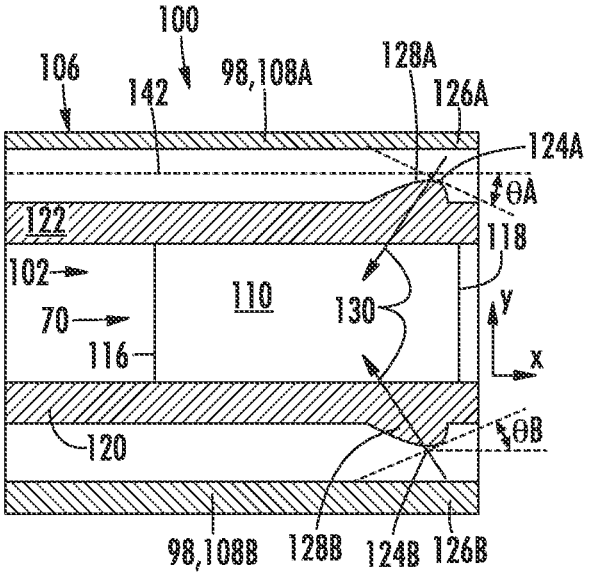
FIG. 6 is a schematic partially exploded side cross-sectional view of a nozzle assembly in accordance with one embodiment of the present disclosure.
Figure 9:
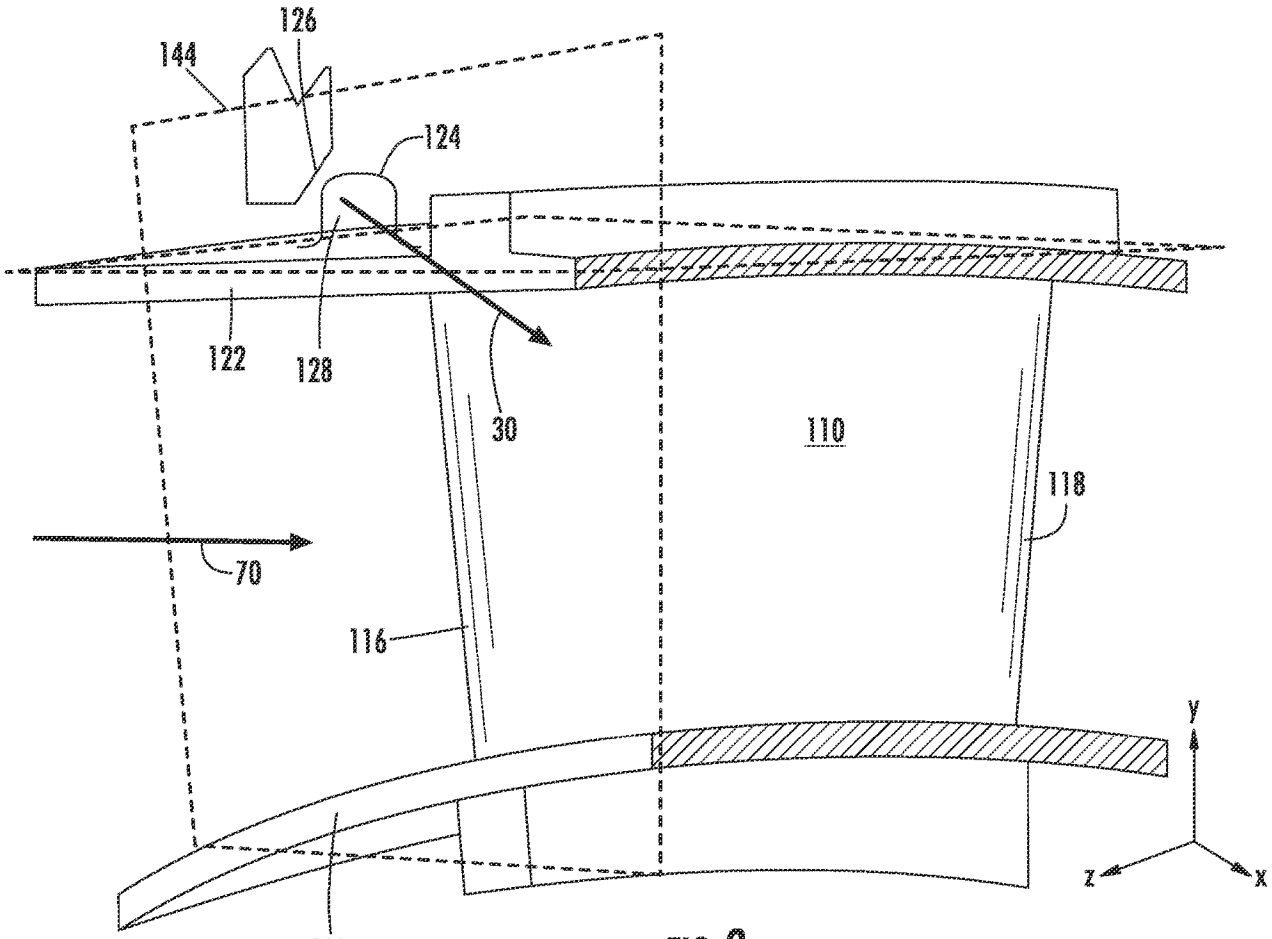
FIG. 9 is a top aft perspective view of a nozzle in accordance with one embodiment of the present disclosure including a protrusion tab.
Figure 10:
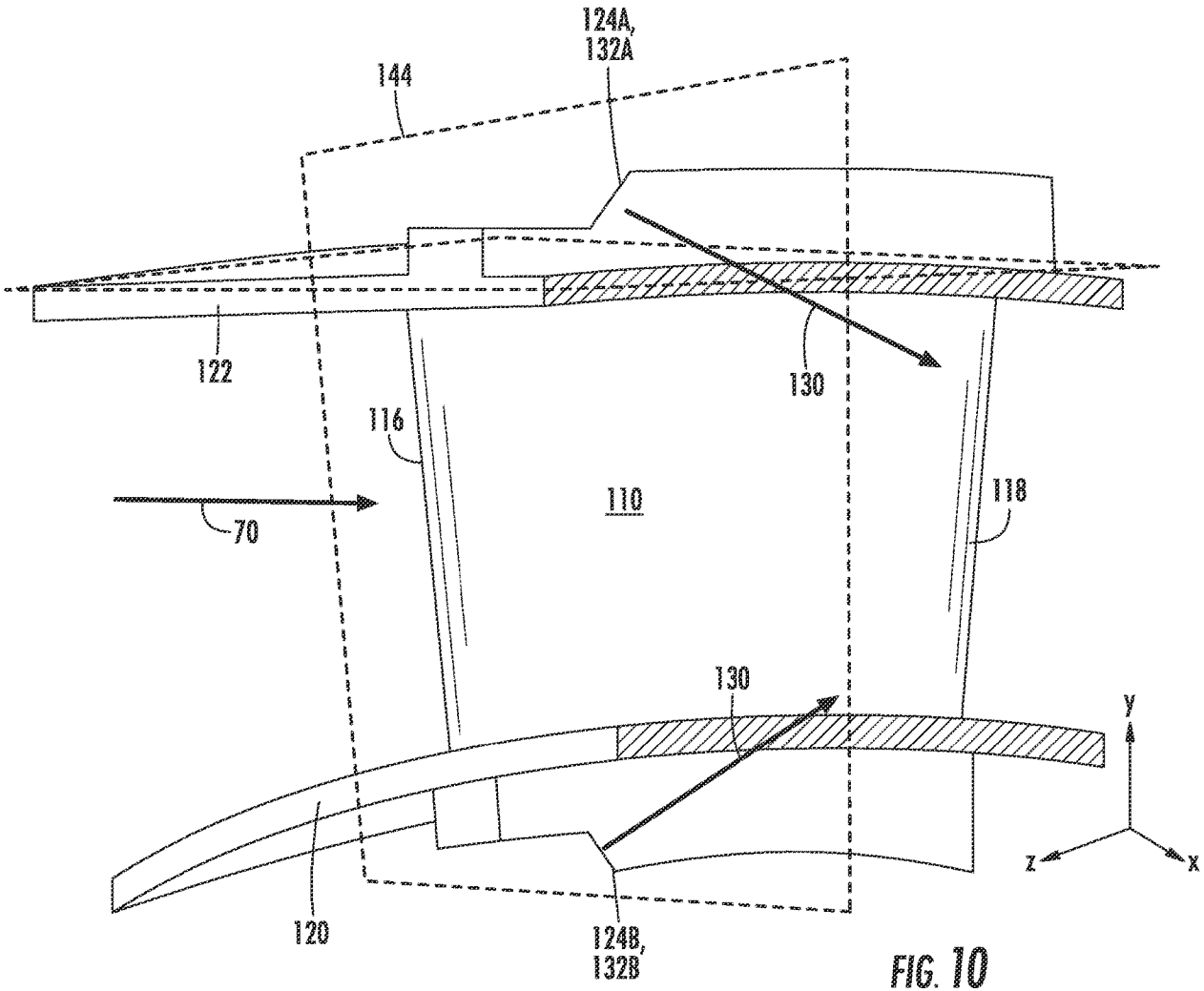
FIG. 10 is a top aft perspective view of a nozzle in accordance with one embodiment of the present disclosure wherein an inner contact face includes an inner fillet and an outer face includes an outer fillet.
Figure 11:
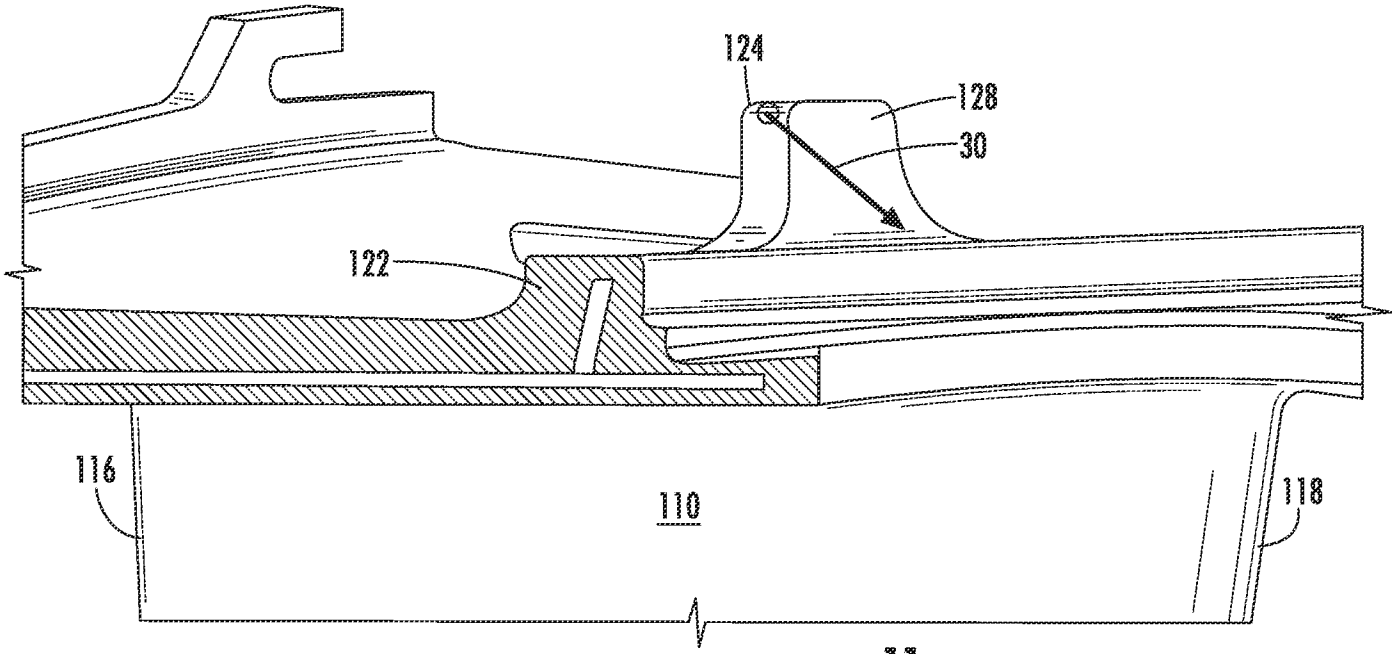
FIG. 11 is a magnified top aft perspective view in accordance with one embodiment of the present disclosure including a protrusion tab.
Figure 13:
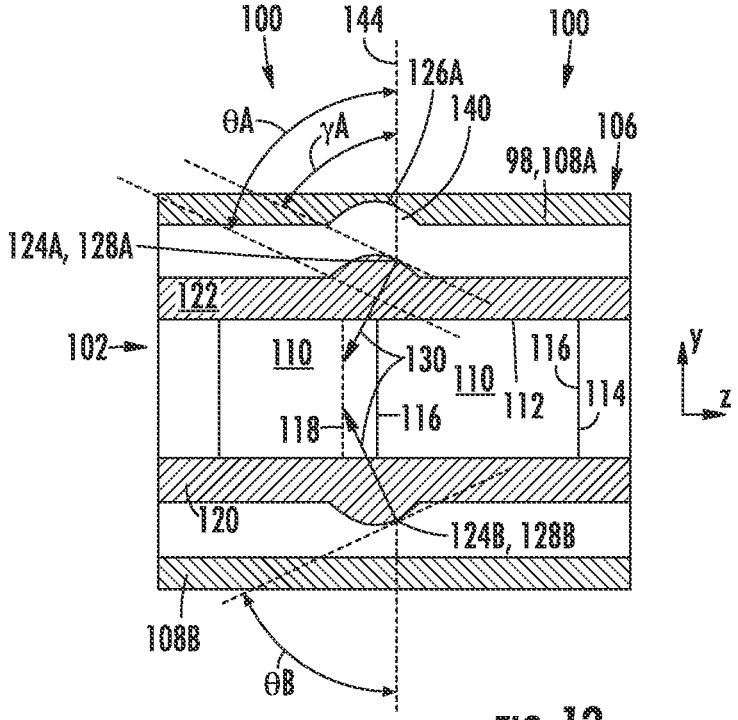
FIG. 13 is a schematic partially exploded front cross-sectional view of a nozzle assembly in accordance with one embodiment of the present disclosure.

Although FIGS. 6 and 13 illustrate embodiments having both an outer protrusion tab 128A and an inner protrusion tab 128B, other embodiments may include only one of the outer protrusion tab 128A and inner protrusion tab 128B. For example, FIG. 9 illustrates a protrusion tab 128 extending from a top surface of the outer flange 122. Moreover, in embodiments including both an outer protrusion tab 128A and an inner protrusion tab 128B, the engagement angle θA of the outer contact face 124A may be the same as the engagement angle θB of the inner contact face 124B, or it may not.

Figure 5:
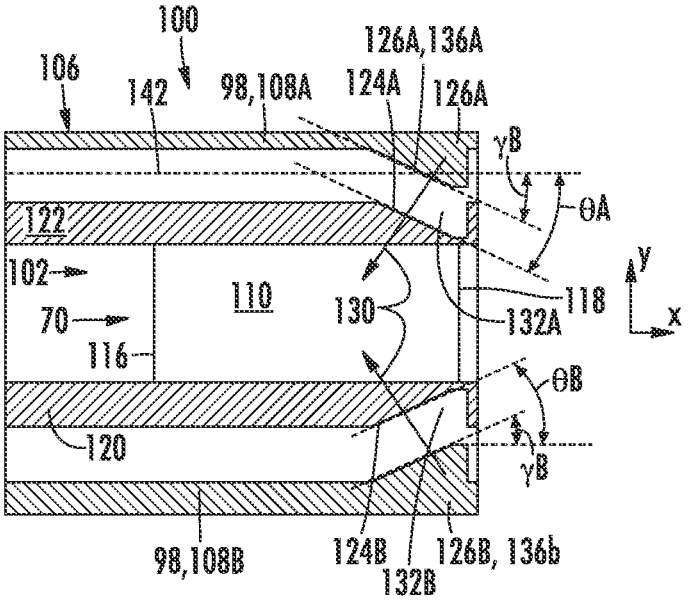
FIG. 5 is a schematic partially exploded side cross-sectional view of a nozzle assembly in accordance with one embodiment of the present disclosure.
Figure 7:
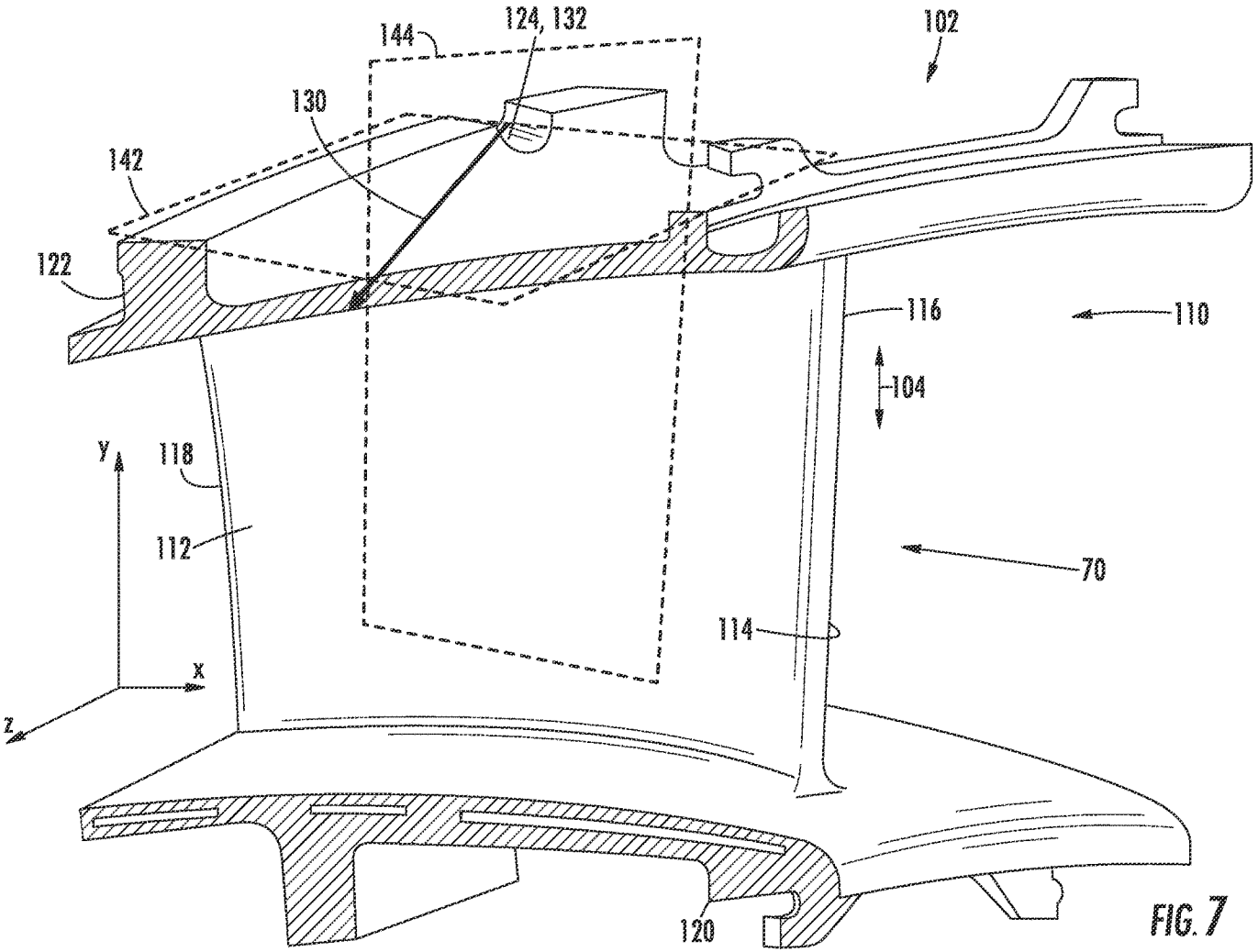
FIG. 7 is a top front perspective view of a portion of a nozzle in accordance with one embodiment of the present disclosure wherein a contact face includes a fillet.
Figure 8:
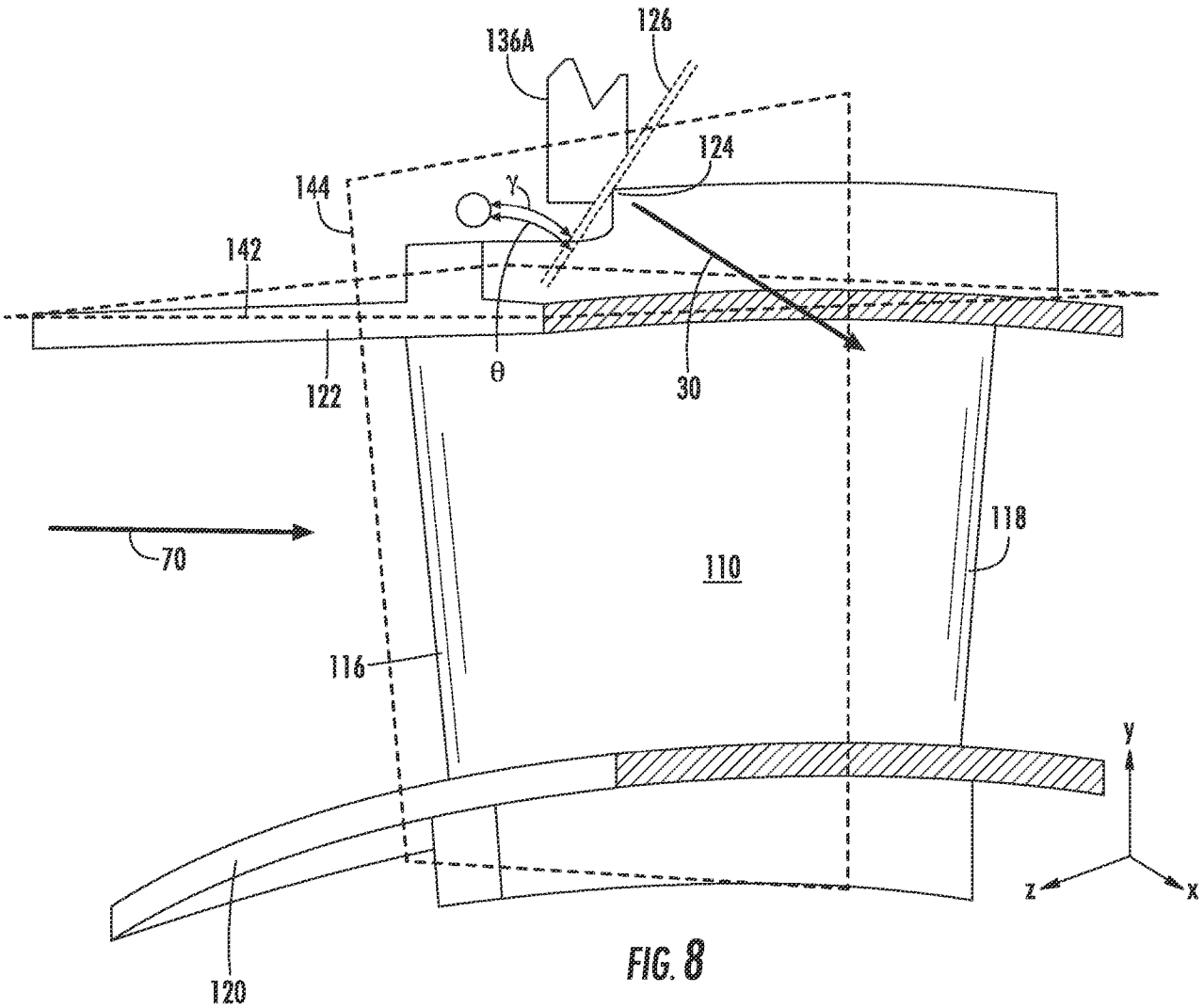
FIG. 8 is a top aft perspective view of a portion of a nozzle in accordance with one embodiment of the present disclosure including an outer biasing foot.
Figure 12:
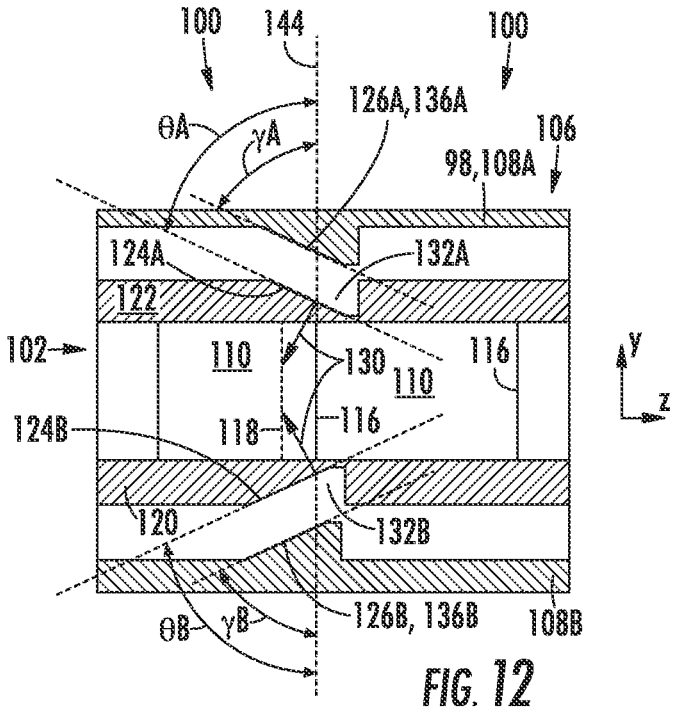
FIG. 12 is a schematic partially exploded front cross-sectional view of a nozzle assembly in accordance with one embodiment of the present disclosure.

In certain embodiments, illustrated in FIGS. 5, 7, and 12, the contact face 124 includes a fillet 132 configured to receive a biasing member at the defined engagement angle θ. FIGS. 3, 4, 8, and 10 further illustrate such embodiments. As shown, some embodiments include an outer fillet 132A facing an outer support frame 108A. Additional or alternative embodiments may include an inner fillet 132B facing an inner support frame 108B. Although FIGS. 12 and 13 illustrate embodiments having both an outer fillet 132A and an inner fillet 132B, other embodiments may include only one of the outer fillet 132A and the inner fillet 132B. Moreover, in embodiments including both an outer fillet 132A and an inner fillet 132B, the engagement angle θA of the outer contact face 124A may be the same as the engagement angle θB of the inner contact face 124B, or it may not. In further embodiments, the compressive contact face 124 may be formed as a substantially flat surface, parallel to the centerline 12.

In exemplary embodiments, the airfoil 110, inner flange 120 and outer flange 122 are formed from ceramic matrix composite ("CMC") materials. Alternatively, however, other suitable materials, such as suitable plastics, composites, metals, etc., may be utilized.

As shown in in the exemplary embodiments of FIGS. 2, 5-6, and 12-3, the shroud assemblies 72, 74 include an airfoil support structure 106 attached to the flanges 120, 122 and radially enclosing the nozzle 102. The support structure 106 of these embodiments includes an outer frame 108A and an inner frame 108B disposed at opposite radial ends of the nozzle 102. Each of the outer frame 108A and the inner frame 108B may also include a support body 98 defining a mating face 126 that is directed toward the nozzle 102 to engage the compressive contact face 124 at an engagement angle γ.

As illustrated in FIGS. 5, 8, 9, and 12, the mating face 126 of certain embodiments includes a biasing foot 136 disposed toward the nozzle 102 to engage the flange 120, 122. The biasing foot 136 may be integrally formed with the flange support body 98, or may be separately attached via an adhesive or mechanical fastener. Although FIGS. 5 and 12 illustrate embodiments having both an outer biasing foot 136A and an inner biasing foot 136B, other embodiments may include only one of the outer biasing foot 136A and inner biasing foot 136B, similar to FIGS. 8 and 9. Moreover, in embodiments including both an outer biasing foot 136A and an inner biasing foot 136B, the engagement angle γA of the outer mating face 126A may be the same as the engagement angle γB of the inner mating face 126B, or it may not. In certain embodiments, the biasing foot 136 includes a shape that is matched to the engagement angle θ of the compressive contact face 124, allowing the biasing foot 136 to extend within a fillet 132 defined by the contact face 124. In optional embodiments, the biasing foot 136 may define its own engagement angle γ, separate and discrete from the engagement angle θ of the compressive contact face 124. In certain embodiments, the mating face 126 includes a substantially flat surface of the flange 120, 122.

In additional or alternative embodiments, such as that shown in FIG. 13, the mating face 126 includes a groove 140 defined by the support body 98. In such embodiments, the mating groove 140 can selectively receive the contact face 124 such that the contact face 124 extends radially into a cavity defined by the groove 140. Although FIG. 13 only illustrates a single outer groove 140, some embodiments may include both an outer groove and an inner groove. Moreover, in embodiments including both an outer groove and an inner groove, the engagement angle γA of the outer mating face 126A may be the same as the engagement angle γB of the inner mating face 126B, or it may not. In optional embodiments, the groove 140 may define its own engagement angle γ, separate and discrete from the engagement angle θ of the compressive contact face 124.

In exemplary embodiments, the outer support frame 108A and inner support frame 108B are formed from metals. Alternatively, however, other suitable materials, such as suitable plastics, composites, etc., may be utilized.

As discussed, nozzles 102 may be subjected to various loads during operation of the engine 10, including loads along an axial direction (as defined along the centerline 12). Further, as discussed, differences in the materials utilized to form a nozzle 102 and associated support structure 106 (i.e., CMC and metal, respectively, in exemplary embodiments) may cause undesirable relative movements of the nozzle 102 and/or support structure 106 during engine operation, in particular along the radial axis 104. It is generally desirable to improve the load transmission between the associated nozzle 102 and support structure 106 and reduce the risk of damage to the component of the nozzle 102 that interface with the support frame 108A, 108B due to such loading and relative movement.

When assembled, the contact face 124 and mating face 126 abut at one of the defined engagement angles θ, γ. Through this engagement, a radial compressive force 130 may be transmitted to the nozzle 102. Generally, the compressive force 130 will be transmitted to the nozzle 102 at an angle perpendicular to one of the engagement angles θ, γ. In certain embodiments, this compressive force 130 can hold the assembled nozzle 102 in rigid compression. Rigid compression may advantageously limit tensile strain and preventing the nozzle 102 from rocking between the support frames 108A, 108B. In some embodiments, the compression will be sufficient to fasten the support frame 108A, 108B and nozzle 102 together, eliminating the need for separate retention pins or features. In addition, the compression may advantageously aid in the radial maintaining radial orientation of the nozzle 102. During operation, heat generated within the engine 10 may cause expansion and strain deflection at the support frame 108A, 108B. The compression generated at the contact face 124 and mating face 126 may be configured to counter the expansion and limit strain.

As shown, one or more planes 142, 144 are defined within the engine 10. A tangential or first plane 142 may be defined from a tangential line along the nozzle flange 120, 122 or support frame 108A, 108B. More specifically, the first plane 142 may be defined perpendicular to the radial axis 104 and parallel to the engine centerline 12. A radial or second plane 144 may be defined through the nozzle 102, itself. The second plane 144 may, moreover, be defined along (and parallel) to the centerline 12 and the radial axis 104.

Generally, the engagement angle θ, γ will be non-orthogonal (i.e., not perpendicular or parallel) to the engine centerline 12. Exemplary embodiments of the engagement angle θ, γ will be formed relative to the first plane 142 and the second plane 144. For instance, in some embodiments, the engagement angle θ, γ is between 90° and 20° relative to the first plane 142. In further embodiments, the engagement angle θ, γ is between 50° and 40° relative to the first plane 142. In other embodiments, the engagement angle θ, γ is between 90° and 20° relative to the second plane 144. In still other embodiments, the engagement angle θ, γ is between 50° and 40° relative to the second plane 144. Optional embodiments of the engagement angle θ, γ will be formed relative to both the first plane 142 and the second plane 144. Either engagement angle θ, γ may be selected and formed according to a desired compression load to be transmitted to the airfoil 110.

Methods are also generally provided for assembling nozzle assemblies 100. An exemplary method includes coupling a nozzle support structure 106 to a nozzle 102. Such coupling may include, for example, positioning an airfoil compressive contact face 124B on top of, and in engagement with, an inner support frame mating face 126B. Subsequently or previously, an outer facing compressive contact face 124A may be positioned beneath, and in engagement with, an outer support frame mating face 126A. The dual engagement may substantially hold the airfoil 110 radially between the support frames 108A, 108B. In certain embodiments, further mounting pins or tabs will be excluded, allowing the airfoil 110 to be held in a predetermined radial position by primarily compressive forces 130.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A nozzle for a gas turbine engine, the nozzle comprising:

an airfoil disposed along a radial axis, the airfoil including an exterior surface defining a pressure side and a suction side extending between a leading edge and a trailing edge, an outer flange extending axially in engagement with the exterior surface, an inner flange extending axially in engagement with the exterior surface, and a radially compressive contact face including a protrusion tab defined on each of the inner flange and outer flange at an engagement angle non-orthogonal to a centerline of the engine, the compressive contact faces being configured to transmit a compressive force perpendicular to the engagement angles; and an airfoil support frame radially enclosing the airfoil, the airfoil support frame including a mating face positioned in engagement with the compressive contact face of the outer flange.

2. The nozzle of claim 1, wherein the mating face comprises a groove defined within the airfoil support frame.

3. The nozzle of claim 1, wherein a first plane is defined perpendicular to the radial axis and parallel to the centerline, and wherein the engagement angle is between 90° and 20° relative to the first plane.

4. The nozzle of claim 3, wherein the engagement angle is between 50° and 40° relative to the first plane.

5. The nozzle of claim 1, wherein a second plane is defined along the engine centerline and the radial axis, and wherein the engagement angle is between 90° and 20° relative to the second plane.

6. The nozzle of claim 5, wherein the engagement angle is between 50° and 40° relative to the second plane.

7. The nozzle of claim 1, wherein the airfoil support frame comprises an outer support frame disposed above the airfoil and defining the mating face.

8. The nozzle of claim 1, wherein the airfoil support frame comprises an inner support frame disposed below the airfoil and defining the mating face.

9. The nozzle of claim 1, wherein the airfoil is formed from a ceramic matrix composite material.

10. A nozzle for a gas turbine engine, the nozzle comprising:

an airfoil disposed along a radial axis, the airfoil including an exterior surface defining a pressure side and a suction side extending between a leading edge and a trailing edge, an outer flange extending axially in engagement with the exterior surface, an inner flange extending axially in engagement with the exterior surface, and a compressive contact face radially positioned away from the exterior surface on each of the outer flange and inner flange; and an inner airfoil support frame and an outer airfoil support frame radially enclosing the airfoil, the airfoil support frames each including a support body and a mating face including a biasing foot defined on each support body at an engagement angle non-orthogonal to the centerline, the mating faces being positioned in engagement with the compressive contact faces along the engagement angles.

11. The nozzle of claim 10, wherein the contact face of each of the inner flange and outer flange comprise a fillet defined within each flange.

12. The nozzle of claim 10, wherein a first plane is defined perpendicular to the radial axis and parallel to the centerline, and wherein the engagement angle is between 90° and 20° relative to the first plane.

13. The nozzle of claim 12, wherein the engagement angle is between 50° and 40° relative to the first plane.

14. The nozzle of claim 10, wherein a second plane is defined along the engine centerline and the radial axis, and wherein the engagement angle is between 90° and 20° relative to the second plane.

15. The nozzle of claim 14, wherein the engagement angle is between 50° and 40° relative to the second plane.

16. The nozzle of claim 10, wherein the airfoil comprises a ceramic matrix composite material.

* * * * *